US006358140B1

(12) United States Patent
Hempel

(10) Patent No.: US 6,358,140 B1
(45) Date of Patent: Mar. 19, 2002

(54) RAILROAD RAIL SUPPORT FOR A GRINDER

(75) Inventor: Chad C. Hempel, Pewaukee, WI (US)

(73) Assignee: FCI USA Inc., Etters, PA (US)

( * ) Notice: Subject to any disclaimer, the term of this patent is extended or adjusted under 35 U.S.C. 154(b) by 0 days.

(21) Appl. No.: 09/430,266

(22) Filed: Oct. 29, 1999

(51) Int. Cl.[7] ..... B24B 23/02
(52) U.S. Cl. ..... 457/347; 451/350; 451/429
(58) Field of Search ..... 451/347, 429, 451/360; 15/54, 55; 404/175; 125/35; 280/649

(56) References Cited

U.S. PATENT DOCUMENTS

| | | | | | |
|---|---|---|---|---|---|
| 2,081,360 | A | * | 5/1937 | Mall | 451/347 |
| 2,983,085 | A | * | 5/1961 | Lutts | 451/85 |
| 3,398,613 | A | * | 8/1968 | Gallotti | 451/347 |
| 3,974,597 | A | | 8/1976 | Hambrick et al. | |
| 4,074,468 | A | | 2/1978 | Panetti | |
| 4,256,325 | A | * | 3/1981 | Fleischer | 280/649 |
| 4,751,794 | A | | 6/1988 | Clem | |
| 4,854,088 | A | | 8/1989 | Clem | |
| 5,253,384 | A | * | 10/1993 | Joines et al. | 15/98 |

FOREIGN PATENT DOCUMENTS

| | | | | |
|---|---|---|---|---|
| EP | 376552 | * | 7/1990 | 451/347 |
| GB | 123964 | * | 3/1919 | 451/347 |
| RU | 158513 | * | 10/1963 | 451/347 |
| GB | 836 | * | 12/1907 | 451/347 |

OTHER PUBLICATIONS

Railway Track–Work Company, Dec. 30, 1935.*

* cited by examiner

*Primary Examiner*—George Nguyen
(74) *Attorney, Agent, or Firm*—Perman & Green, LLP

(57) ABSTRACT

A grinder support apparatus for supporting a grinder on a railroad rail. The apparatus comprises a support wheel adapted to roll on a top surface of the rail, and a frame having the support wheel connected thereto. The frame comprises a handle for a user to move the support wheel and frame along the rail and a support section for removably connecting the grinder to the frame. A grinding wheel of the grinder can contact a surface of the rail as the support wheel contacts the top surface.

12 Claims, 4 Drawing Sheets

RAILROAD RAIL SUPPORT FOR A GRINDER

BACKGROUND OF THE INVENTION

1. Field of the Invention

The present invention relates to tools and, more particularly, to a tool for supporting a grinder on a railroad rail.

2. Prior Art

Hand-held hydraulically operated grinders exist which are used to grind deteriorated metal and finish grind sides on frogs, railends and switches of railroad rail tracks. These areas would primarily require freehand grinding in which the operator would be put in a bent over position. This is not ergonomic and puts the operator at risk of back injury. U.S. Pat. Nos. 3,974,597 and 4,751,794 describe apparatus for grinding a base of a railroad rail, but not a head of a rail and, cannot be easily used in tight areas that would otherwise need freehand grinding with a hand-held grinder.

SUMMARY OF THE INVENTION

In accordance with one embodiment of the present invention, a grinder support apparatus for supporting a grinder on a railroad rail is provided comprising a support wheel adapted to roll on a top surface of the rail, and a frame having the support wheel connected thereto. The frame comprises a handle for a user to move the support wheel and frame along the rail and a support section for removably connecting the grinder to the frame. A grinding wheel of the grinder can contact a surface of the rail as the support wheel contacts the top surface.

In accordance with another embodiment of the present invention, a railroad rail grinding apparatus is provided comprising a grinder and a support. The grinder has a rotatable grinding wheel. The support has the grinder connected thereto. The support comprises a frame having a handle and a support wheel connected to the frame. The apparatus is adapted to be supported by contact on a top surface of a railroad rail with only the support wheel and the grinding wheel on the top surface.

In accordance with another embodiment of the present invention, a grinder support device for supporting a grinder on a railroad rail is provided. The grinder support device comprises a roller and a frame. The roller is adapted to roll on the railroad rail. The frame is connected to the roller. The frame comprises a handle and a connection section for removably connecting a hand-held grinder to the frame. The frame is collapsible from a first operational configuration to a second collapsed storage configuration.

In accordance with another embodiment of the present invention, a hand-held grinding apparatus is provided having a drive section, a grinding wheel connected to the drive section, and a cover located over a portion of the grinding wheel. The improvement comprises the cover having at least one connection section for connecting the cover to a frame of a support for at least partially supporting the grinding apparatus on a railroad rail.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
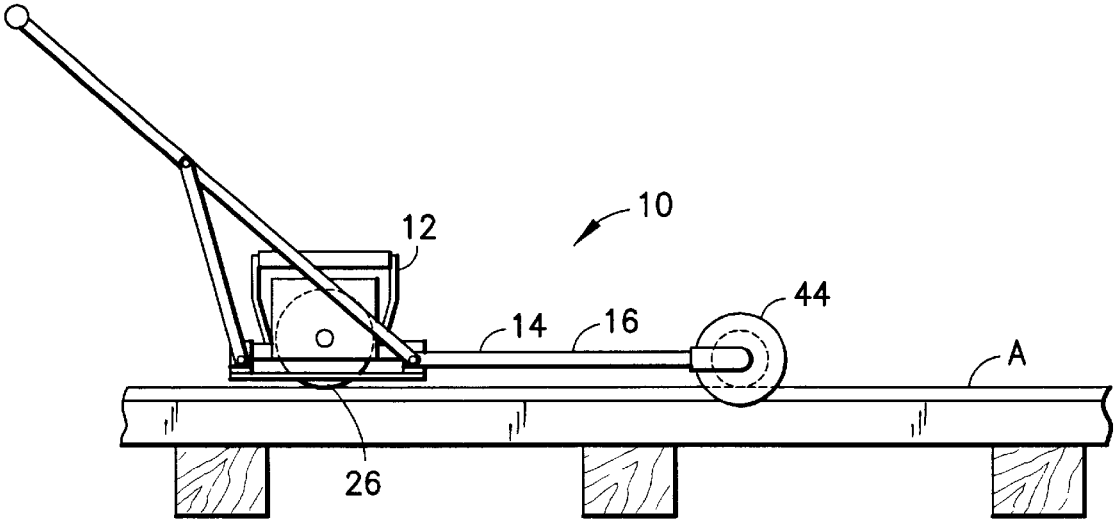
FIG. 1 is a schematic side elevational view of an apparatus incorporating features of the present invention shown located on top of a railroad rail.

Referring to FIG. 1, there is shown a schematic side elevational view of an apparatus 10 incorporating features of the present invention located on a railroad rail A. Although the present invention will be described with reference to the single embodiment shown in the drawings, it should be understood that the present invention can be embodied in many alternate forms of embodiments. In addition, any suitable size, shape or type of elements or materials could be used.

Figure 1A:
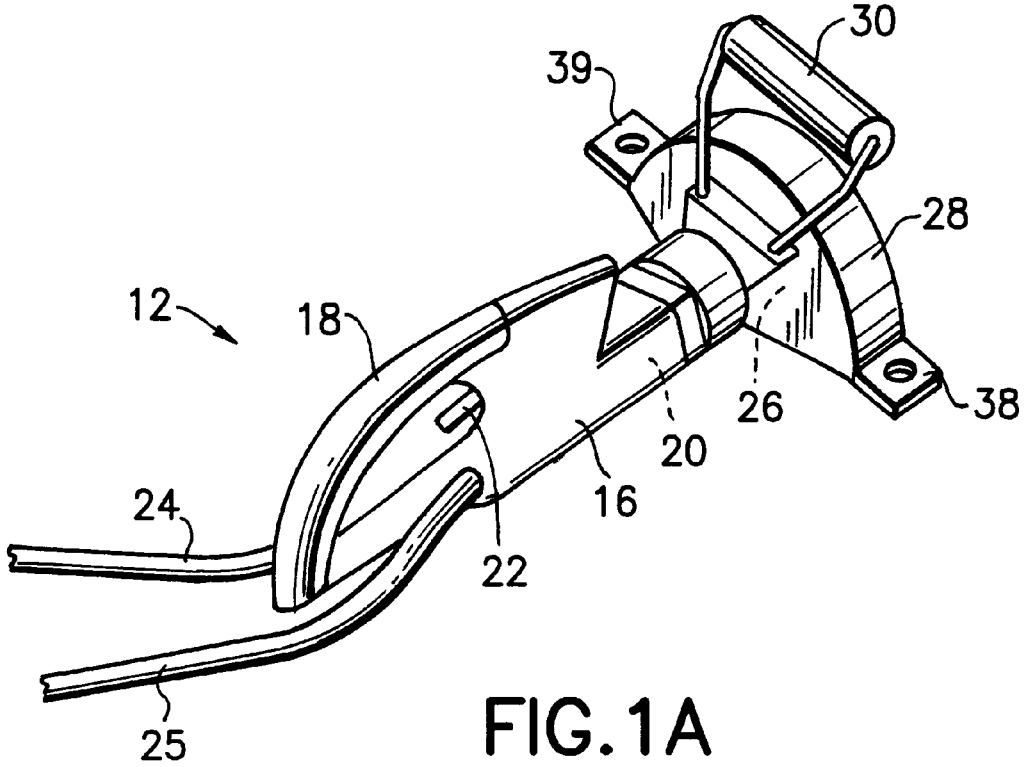
FIG. 1A is a perspective view of the hand-held grinder shown in FIG. 1.
Figure 1B:
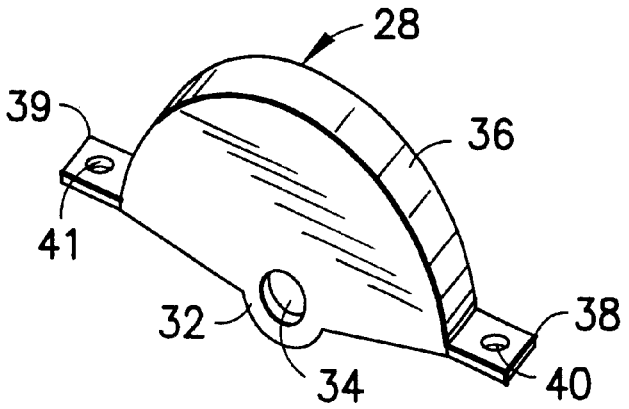
FIG. 1B is a perspective view of the cover of the grinder shown in FIG. 1A.

The apparatus 10 generally comprises a grinder 12 and a support 14. The apparatus 10 is generally intended to grind deteriorated metal and finish grinding of sides on frogs, railends and switches of railroad rails. Referring also to FIG. 1A, the grinder 12 is preferably a hand-held unit that is hydraulically driven, similar to a HGBH8 grinder sold by the Racine division of Framatome Connectors International. The grinder 12 generally comprises a frame 16 having a rear handle 18, a drive section 20 located in the frame, a lever actuator 22 connected to the drive section 20, hydraulic fluid supply and return hoses 24, 25, a grinding wheel 26, a grinding wheel cover 28, and a front handle 30. However, any suitable grinder could be provided. The grinder 12 is substantially identical to the HGBH8 grinder with the exception of the cover 28. Referring also to FIG. 1B, the cover 28 has a side flange 32 for mounting the cover 28 to the frame 16, a hole 34 to allow a drive shaft from the drive section 20 to extend into the cover 28, a covering section 36 to cover a portion of the grinding wheel 26, and two mounting flanges 38, 39. The two mounting flanges 38, 39 extend from front and rear ends of the covering section 36. In this embodiment the mounting flanges 38, 39 each comprise a mounting hole 40, 41 to allow a fastener (not shown), such as a bolt, to connect the flanges 38, 39 to the support 14. However, in alternate embodiments, the cover could include any suitable type of shape or configuration to allow the cover to be connected to the support. Alternatively, the grinder 12 could have additional or alternative means to connect or mount the grinder to the support.

Figure 2:
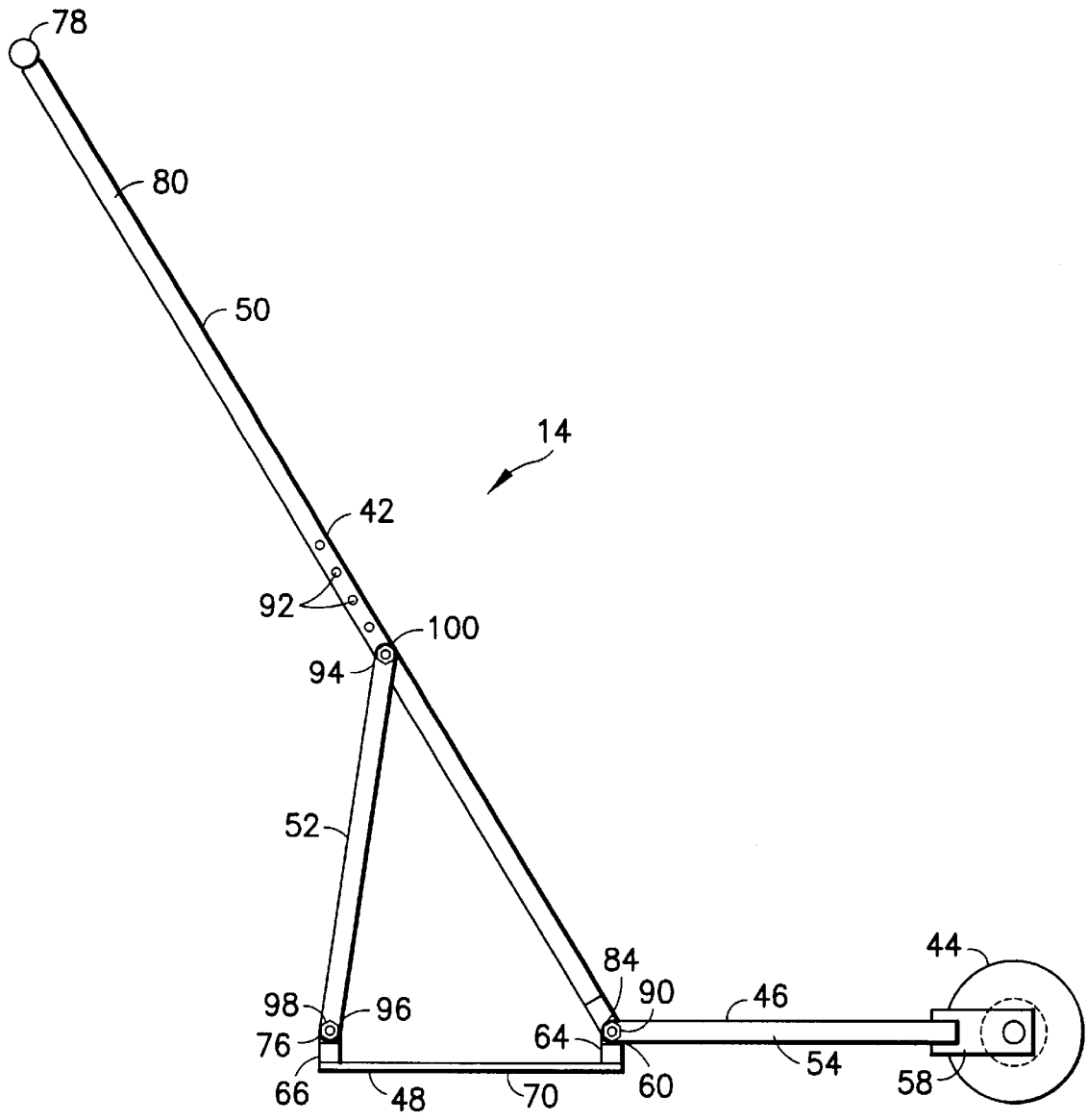
FIG. 2 is a side elevational view of the support of the apparatus shown in FIG. 1.
Figure 3A:
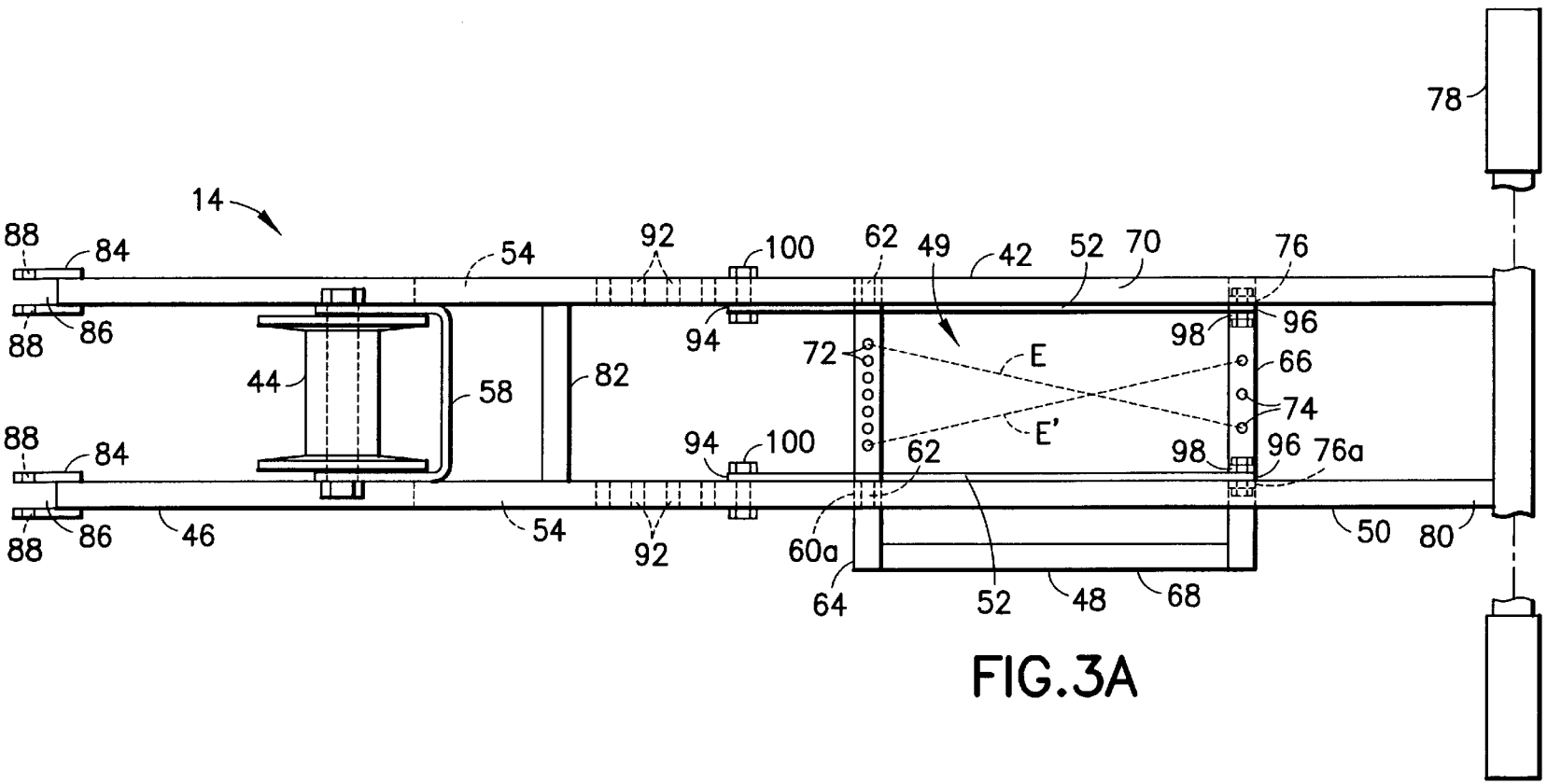
FIG. 3A is a top plan view of the support shown in FIG. 2 in a collapsed storage configuration.
Figure 3B:
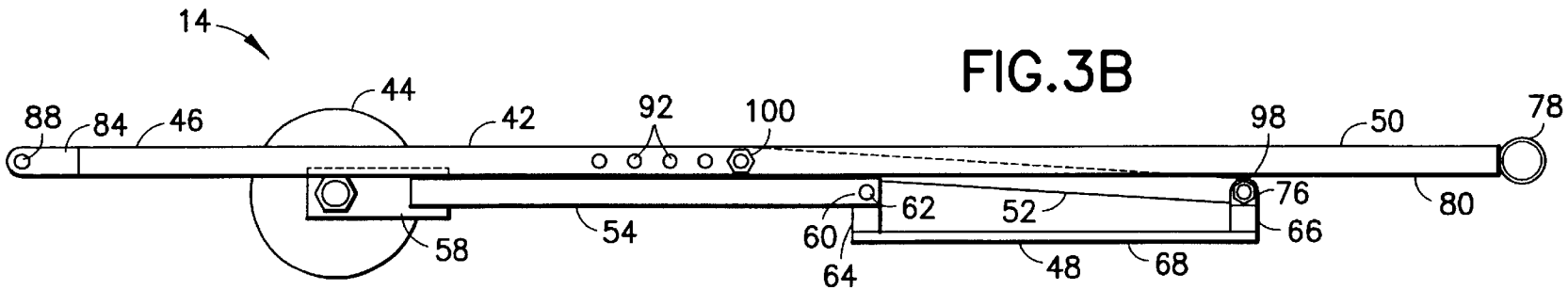
FIG. 3B is a side elevational view of the support shown in FIG. 3A.

Referring also to FIG. 2, a side elevational view of the support 14 is shown with the support in an expanded operational configuration. FIGS. 3A and 3B show top plan and side elevational views, respectively, of the support 14 in a collapsed storage configuration. The support generally comprises a frame 42 and a single wheel or roller 44. In this embodiment the frame 42 generally comprises a front section 46, a support section 48, a handle section 50, and two connecting pieces 52. The frame 42 is preferably comprised of metal, such as including tubular metal sections welded together. The front section 46 includes two beams 54 and a general U-shaped wheel mounting section 58 connected to a front end of the two beams, such as by welding. Rear ends 60 of the beams 54 are fixedly connected to a front cross-beam 64 of the support section 48, such as by welding. However, any suitable connection could be provided. The rear ends 60 also include transverse holes 62.

The support section 48 has a general square or rectangular shape. However, any suitable shape or configuration could be provided. The support section 48 generally comprises the front cross-beam 64, a rear cross-beam 66, and two side support beams 68, 70. The side support beams 68, 70 fixedly connect the cross-beams 64, 66 to each other, such as by welding. The front cross-beam 64 has holes 72 for receiving a fastener (not shown) to connect the front flange 39 (see FIGS. 1A and 1B) of the grinder's cover 28 to the support section 48. The rear cross-beam 66 also has holes 74 for receiving a fastener (not shown) to connect the rear flange 38 of the grinder's cover 28 to the support section 48. The rear cross-beam 66 also comprises pivot mounts 76 on a top side of the rear cross-beam 66. The left side pivot mount 76*a* is connected to the rear cross-beam at a distance spaced inward from the connection of the left side beam 68 to the rear cross-beam 66. The end 60*a* of the left side front section beam 54 is also connected to the front cross-beam 64 at a distance spaced inward from the connection of the left side beam 68 to the front cross-beam 66. As seen best in FIG. 3A, this forms the left side beam 68 as a laterally extended section. An open area 49 is formed in the support section 48 between the cross-beams 64, 66 and the side beams 68, 70 for the grinding wheel 26 to project below the support section 48. The plurality of holes 74 and the plurality of holes 72 allow the grinder 12 to be connected to the frame 42 at any one of a plurality of different positions. Alternatively, the holes 72, 74 allow different grinders having different cover mounting flange configurations to be connected to the support section 48.

The handle section 50 generally comprises a rear end handle 78, two side beams 80, a cross-beam 82, and two mounts 84 at front ends of the two side beams 80. The handle 78 and the cross-beam 82 keep the two side beams 80 at a fixed relationship relative to each other. The two front end mounts 84 each have a receiving area 86 and holes 88. The mounts 84 are sized and shaped to receive the rear ends 60 of the side beams 54 of the front section 46 therein. Fasteners 90, such as bolts, can be inserted into the holes 62, 88 when the holes are aligned to fixedly, but removably or adjustably connect the front of the handle section 50 to the front section 46. The two side beams 80 of the handle section 50 also comprises holes 92.

The two connecting pieces 52 each generally comprise a top end 94 having a connecting hole and a bottom end 96 having a connecting hole. The bottom ends 96 are pivotably connected to the pivot mounts 76 by fasteners 98. The top ends 94 are pivotably connected to the handle section side beams 80 at holes 92 by fasteners 100. The frame 42 of the support 14 is reconfigurable between the two positions or configurations shown in FIG. 2 and FIGS. 3A and 3B with the two connecting pieces 52 merely pivoting at the fasteners 98, 100. The frame 42 can be locked in the expanded operational configuration shown in FIG. 2 by placing the fasteners 90 (see FIG. 2) in the holes 62, 88 when the holes are aligned. In this embodiment a plurality of the holes 92 is provided in each handle section side beam 80 in order to allow a user to adjust the height of the rear end handle 78. In an alternate embodiment any suitable type of handle height adjustment system could be provided. Alternatively, the frame of the support need not have an adjustable height handle.

As noted above, the support 14 is adapted to have the hand-held grinder 12 attached to it to form the apparatus 10. The attachment, in this embodiment, merely comprises two fasteners attaching the flanges 38, 39 to the cross-beams 64,66, respectively. In addition, however, the laterally extending side beam 68 of the support section 48 can also function as a support for the frame 16 of the grinder 12. More specifically, the bottom of the grinder frame 16 can rest upon the top surface of the side beam 68. In alternate embodiments the support section could have any suitable configuration to connect and/or support the grinder 12 thereon. For example, the support section 48 could include a laterally offset side support beam connected between the front and rear cross-beams, a top surface of the side support beam 68 forming a support for a portion of the grinder 12 to seat thereon.

Figure 4:
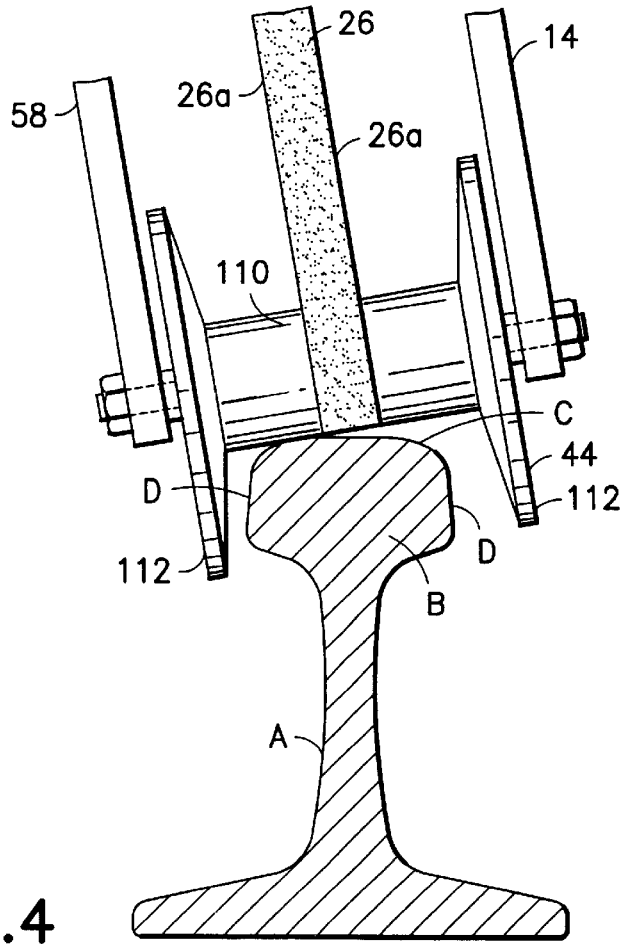
FIG. 4 is a schematic rear elevational view of the grinder wheel and support wheel on the railroad rail shown in FIG. 1.

As can be seen with reference to FIGS. 1 and 4, when the frame 42 of the support 14 is in its expanded operational position and the grinder 12 attached to the support, the apparatus 10 can be placed on a railroad rail A to allow a user to perform a grinding operation on the rail A without the user having to bend down or kneel down. The front wheel 44 can be placed on the head or ball B of the rail A to support the front end of the support 14 on the rail during grinding. Alternatively, the front wheel 44 can be moved off of the ball B during grinding if desired. In this embodiment, the wheel 44 has a center rolling support section 110 and two side flanges 112. The center section 110 can roll on the top surface C of the rail A. The flanges 112 can be located on opposite sides of the ball B. The spacing between the flanges 112 is larger than the width of the ball B such that the support 14 can laterally pivot on the rail A at the wheel 44 to laterally move the grinder wheel 26 across the entire width of the top surface C. The grinding wheel 26 can also grind down the sides D of the ball and at the bottom corner of the sides D, such as by grinding the sides D with the sides 26*a* of the grinding wheel 26. Over time, as railroad cars travel on the rail A, the ball B can be deformed; being slightly flattened by the weight of the cars. The grinding wheel 26 can grind the sides D of the ball B to removed shavings and keep side dimensions of the ball B proper, such as at a rail switch where lateral sides of rail sections are moved into and out of contact with each other. With the present invention, the grinder 12 can also be mounted to the support 14 at an angle relative to the centerline of the support as illustrated by lines E and E' in FIG. 3A; between holes 72 and 74 which are offset from each other. By angling the grinder as illustrated by lines E and E', contact of the side 26*a* with the side D can be localized such that the contact is not along a planar length of the side 26*a*. This can speed up grinding of the side D. In alternate embodiments the support 14 could have any suitable wheel, roller or movable track contacting system, and any pivot system or grinder wheel lateral movement system could be provided.

With the front wheel 44 on the rail A the only other contact of the apparatus 10 with the rail A is by the grinding wheel 26. The apparatus 10 can be pushed and pulled back and forth over an area while the grinding wheel is rotating to grind the surfaces C and/or D of the ball B. The majority of the weight of the grinder 12 and support 14 is on the rail A; not having to be lifted by the user. The user would only have to support half of the weight of the apparatus 10 during side D grinding and, while standing up. Thus, there is less risk of strain to the user or the user's back as in the prior art when the user had to bend down or kneel down with a hand-held grinder. The present invention also provides the advantage of easier transportation of the grinder to a work site. The entire apparatus 10 can merely be rolled along the rail A to the work site, or between work sites, without the user having to lift the apparatus 10 off of the rail A. The apparatus 10 only needs to be lifted off the rail A to shift between parallel rails of the railroad track, and the grinder 12 and support 14 can be disconnected from each other and then removed from the rail at the end of work. Thus, there is a reduced risk of injury to the user and the user will become less fatigued over periods of prolonged grinding. At the end of work, the grinder 12 and support 14 can be disassembled from each other for storage, such as in a work truck. To allow for easier and more compact storage of the support 14, the fasteners 90 can be removed and the frame collapsed to its flat configuration shown in FIGS. 3A and 3B. The support 14 could have a suitable latch system (not shown) to maintain the frame in its flat storage configuration. In an alternate embodiment, the support 14 need not be reconfigurable to a flat storage configuration. With the present invention, it is possible to keep the operator in an upright position, thus avoiding compromising positions. The support will accept a HGBH8 grinder by merely providing the new cover 28. The support can adjust for various operator heights, pivot to address the rail at different angles, and flatten into a small footprint for storage.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A grinder support apparatus for supporting a grinder on a railroad rail, the apparatus comprising:

a support wheel adapted to roll on a top surface of the rail; and a frame having the support wheel connected thereto, the frame comprising a handle for a user to move the support wheel and frame along the rail and a support section for removably connecting the grinder to the frame such that a grinding wheel of the grinder can contact the top surface of the rail as the support wheel contacts the top surface, the support wheel being the sole support wheel for rolling on the rail.

2. An apparatus as in claim 1 wherein the frame is adjustable to adjust a height of the handle.

3. An apparatus as in claim 1 wherein the frame is configurable between a collapsed storage configuration and an expanded operational configuration.

4. An apparatus as in claim 1 wherein the support section comprises front and rear cross-beams with an open area between the cross-beams for a grinding wheel of the grinder to rotatably extend through.

5. An apparatus as in claim 4 wherein the cross-beams comprise connection areas for connecting the grinder to the frame at multiple different positions relative to the frame.

6. An apparatus as in claim 4 wherein the support section comprises a laterally offset side support beam connected between the front and rear cross-beams, a top surface of the side support beam forming a support for a portion of the grinder to seat thereon.

7. A railroad rail grinding apparatus comprising:

a grinder having a rotatable grinding wheel; and a support having the grinder connected thereto, the support comprising a frame having a handle and a support wheel connected to the frame, the support wheel being the sole support wheel for rolling on the rail wherein the apparatus is adapted to be supported by contact on a top surface of a railroad rail of only the support wheel and the grinding wheel on the top surface.

8. An apparatus as in claim 7 wherein the grinder comprises a hand-held grinder having handles and wherein the grinder is removably connected to the support.

9. An apparatus as in claim 8 wherein the grinder comprises a cover partially surrounding a grinding wheel of the grinder, and wherein the cover is connected to the support.

10. An apparatus as in claim 7 wherein the frame is collapsible to a collapsed storage configuration from an expanded operational configuration.

11. An apparatus as in claim 7 wherein the handle has an adjustable height relative to the support wheel and grinding wheel.

12. An apparatus as in claim 7 wherein the frame comprises a lateral generally horizontal support beam having a frame of the grinder being supported on a top surface of the support beam.

* * * * *